US005156634A

United States Patent [19]

Yang

[11] Patent Number: 5,156,634

[45] Date of Patent: Oct. 20, 1992

[54] CUP WASHING MACHINE

[76] Inventor: Jack Yang, No. 7, 39th Str., Lane 399, Sec. 3, Chungshan Rd., Tan Tzu Hsiang, Taichung Hsien, Taiwan

[21] Appl. No.: 747,518

[22] Filed: Aug. 20, 1991

[51] Int. Cl.[5] ..... A46B 13/02; A46B 17/00

[52] U.S. Cl. ..... 15/75; 15/74; 15/88.3

[58] Field of Search ..... 15/71, 73-76, 15/56, 88.3, 39

[56] References Cited

U.S. PATENT DOCUMENTS

| | | | |
|---|---|---|---|
| 2,104,272 | 1/1938 | Partridge | 15/76 |
| 2,631,313 | 3/1953 | Webber | 15/75 |
| 4,791,693 | 12/1988 | Kraternik | 15/88.3 |

FOREIGN PATENT DOCUMENTS

| | | | |
|---|---|---|---|
| 599777 | 11/1959 | Italy | 15/75 |
| 53933 | 10/1910 | Switzerland | 15/71 |

*Primary Examiner*—Edward L. Roberts
*Attorney, Agent, or Firm*—Bacon & Thomas

[57] ABSTRACT

A horizontal cup washing machine comprising a fan motor to drive a plurality of tube brushes to rotate via a gear power transmission mechanism and a plurality of output shafts. The casing of the machine has a plurality of tube brush holder means for holding the tube brushes permitting the tube brushes to be dried by the air when they are not in use. An elongated recess and a plate spring are made on the bottom edge of the casing of the machine so that it can be conveniently attached to the casing of a water faucet by a lock screw.

3 Claims, 4 Drawing Sheets

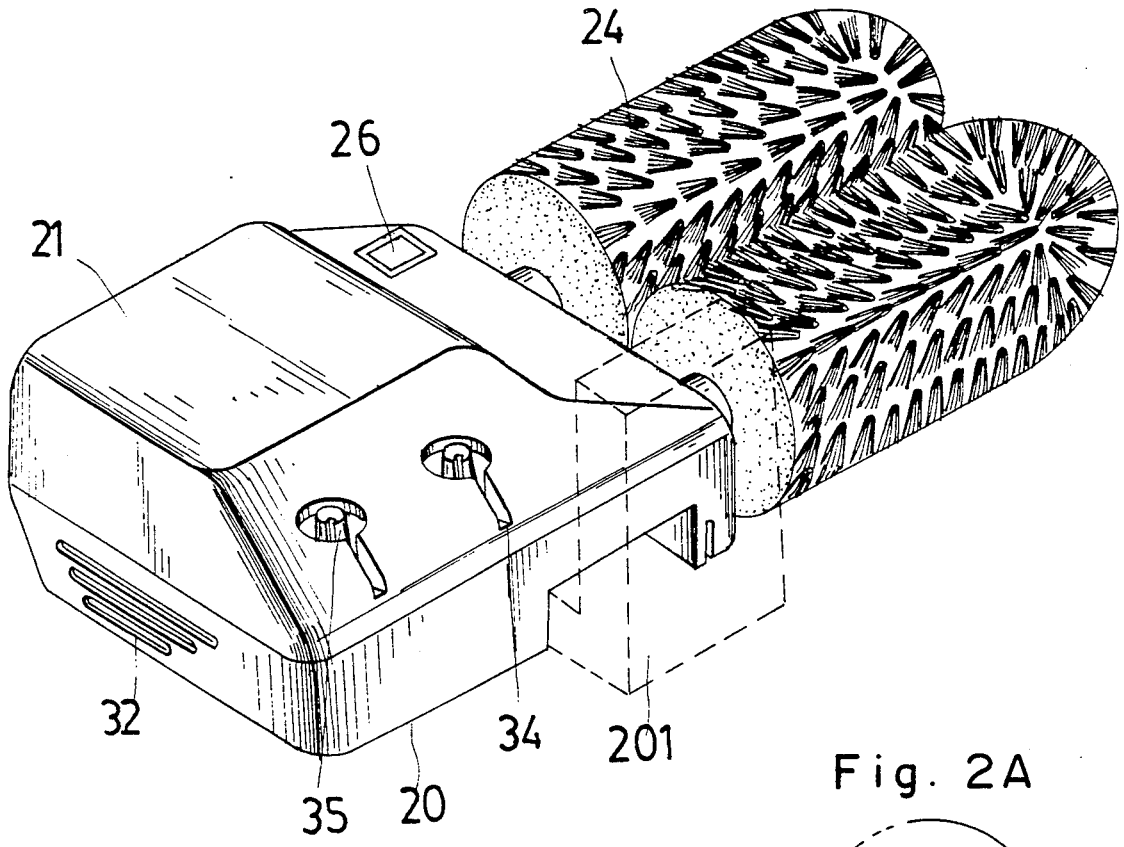
Fig. 2
Fig. 2A
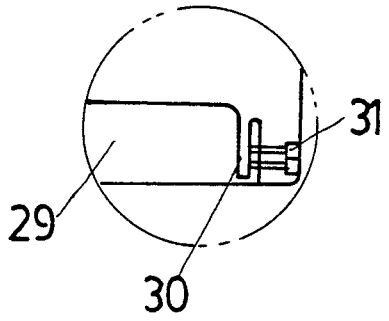

CUP WASHING MACHINE

BACKGROUND OF THE INVENTION

The present invention relates to a horizontal cup washing machine and relates more particularly to such a horizontal cup washing machine which can be conveniently attached to the casing of a water faucet so that washing becomes easy.

Various cup washing machines have been known. FIG. 1 illustrates a vertical cup washing machine according to the prior art in which a plurality of brushes are mounted on a base and coupled to the output shaft of a driving motor through a belt transmission mechanism. When in use, the base and the brushes thereof must be dipped in water which is contained in a sink or a water container. This vertical cup washing machine is big and heavy and not convenient in use. When in use, a relatively bigger sink or water container must be used. Because the base and the brushes must be dipped into water, the driving motor may be dampened by splashed water causing electric leakage or electric shock. Further, the brushes are fixedly secured to the base, and therefore, it is very difficult to replace or change the brushes.

SUMMARY OF THE INVENTION

The present invention has been accomplished to eliminate the aforesaid problems and disadvantages. It is therefore an object of the present invention to provide a horizontal cup washing machine which is compact and light. It is another object of the present invention to provide a horizontal cup washing machine which is practical and safe in use. It is still another object of the present invention to provide a horizontal cup washing machine which is inexpensive to manufacture. It is still another object of the present invention to provide a horizontal cup washing machine which has means to hold the brushes for air drying when not in use. It is still another object of the present invention in which the brushes can be conveniently changed according to the size of the cups to be cleaned or replaced with new ones when damaged.

BRIEF DESCRIPTION OF THE DRAWINGS

FIG. 2 is an elevational view of the preferred embodiment of the horizontal cup washing machine of the present invention;

FIG. 2A illustrates that the screw is screwed inwards to press against the plate spring toward the recessed hole on the bottom edge of the base;

DETAILED DESCRIPTION OF THE PREFERRED EMBODIMENT

Figure 1:
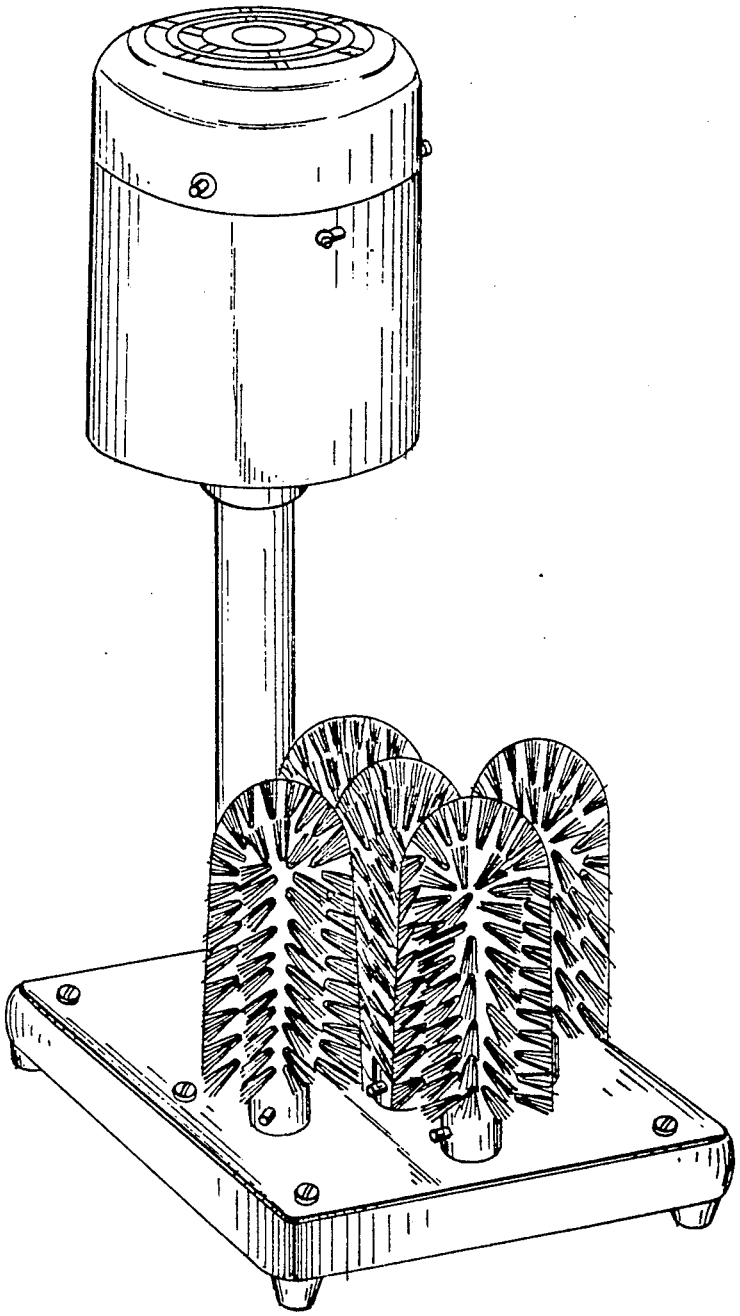
Fig 1 PRIOR ART
FIG. 1 illustrates a vertical cup washing machine according to the prior art.
Figure 3:
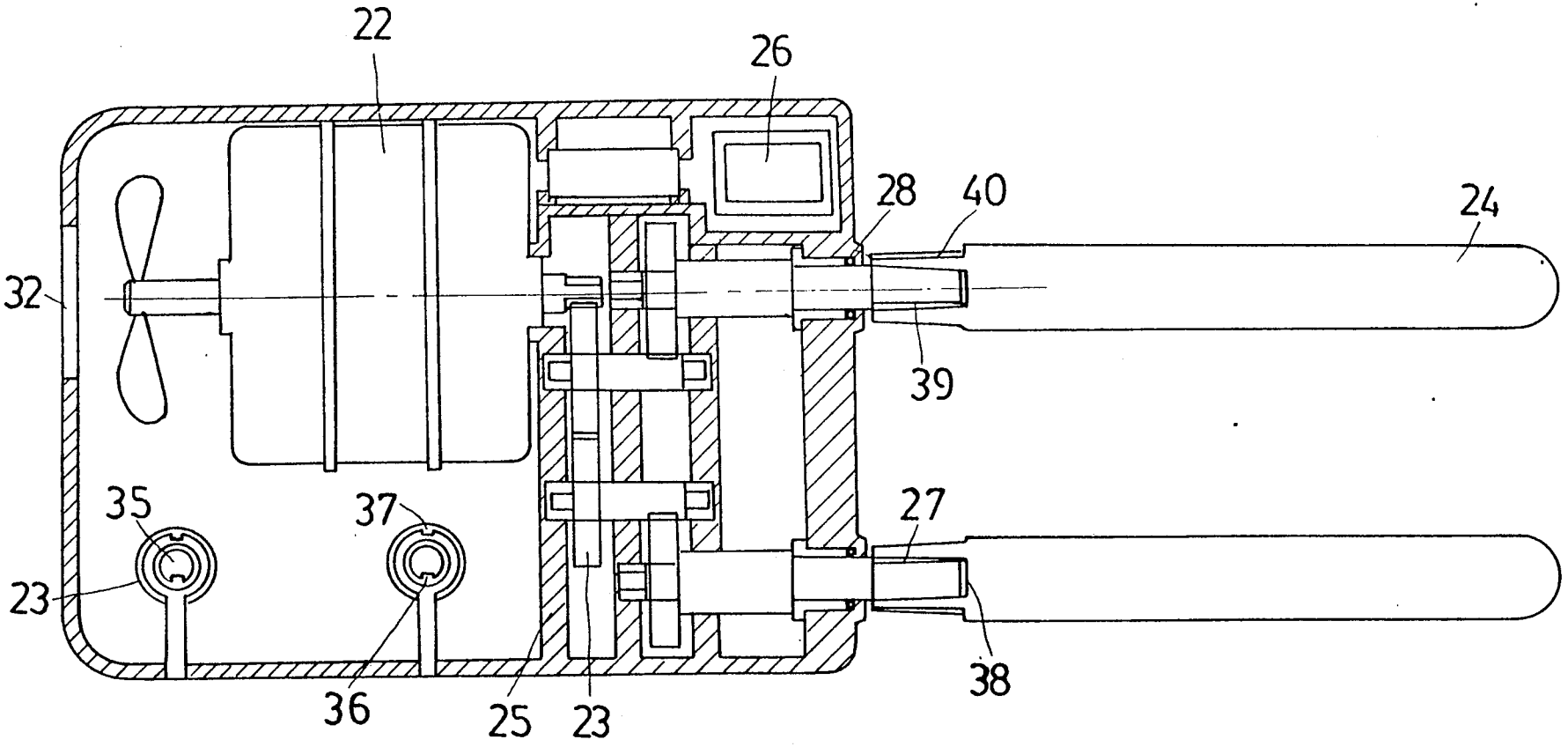
FIG. 3 is a sectional plan view of the preferred embodiment of the horizontal cup washing machine of the present invention.

Referring to FIGS. 2 and 3, therein illustrated is a horizontal cup washing machine embodying the present invention which is generally comprised of a base 20, a cover 21, a fan motor 22, a gear power transmission mechanism 23, and a plurality of tube brushes 24. The cover 21 covers on the base 20 and firmly secured in place by fastening means. The holding space inside the cover 21 and the base 20 is divided into separate chambers by partitions 25 for mounting the fan motor 22 and the transmission gears 23 separately. There is a power switch 26 made on the cover 21 at a suitable location for controlling the operation of the fan motor 22. The gear power transmission mechanism 23 is coupled to the output shaft of the fan motor 22 and driven to carry a plurality of output shafts 27 to rotate. The tube brushes 24 are respectively mounted on the output shafts 27 of the gear power transmission mechanism 23. Each tube brush 24 has a tapered shaft which has a tapered blind hole 38 at one end in longitudinal direction for mounting on either output shaft 27, a groove 40 longitudinally made on the outer wall surface of the tapered shaft thereof and a raised portion 39 on the inner wall surface of the tapered shaft thereof. Each output shaft 27 of the gear power transmission mechanism 23 has a groove (not shown) on the outer wall surface thereof in longitudinal direction. When a tube brush 24 is mounted on either output shaft 27 of the gear power transmission mechanism 23, the raised portion 39 on the inner wall surface of the shaft of the tube brush is engaged into the groove on the output shaft 27 of the gear power transmission mechanism 23, and therefore, rotating the fan motor 22 causes the tube brush 24 to rotate continuously. The base 20 has a recessed hole 29 and a plate spring 30 on the bottom edge thereof (see FIG. 2A). By means of the recessed hole 29, the base 20 can be mounted on the casing of a water faucet or on a L-shaped block 201 and firmly secured thereto by screwing a screw 31 into a hole (not shown) on the base 20 against the plate spring 30. The base further comprises a ventilation port 32 adjacent to the fan motor 22 for heat dissipation. Further, the cover 21 has a plurality of ring-shaped recessed holes 33 on the top edge thereof at suitable locations each of which has an elongated groove 34 obliquely extending to the peripheral bottom edge of the cover 21, a raised portion 37 raising from the peripheral surface thereof in vertical direction and a tapered stub rod 35 upstanding therefrom at the center, which stub rod 35 has a groove 36 corresponding to the raised portion 39 on each tube brush 24. By inserting the tapered hole 38 on the stub rod 35 permitting the raised portion 37 and the groove to be respectively engaged with the groove 40 and the raised portion 39, either tube brush 24 can be mounted on either ring-shaped recessed hole 33 when not in use.

Figure 4:
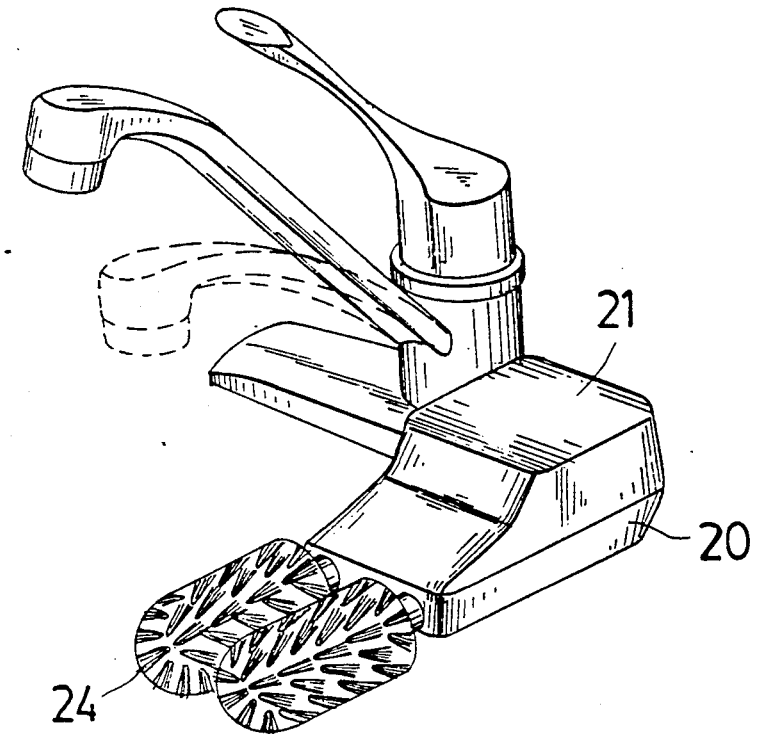
FIG. 4 illustrates that the horizontal cup washing machine of the present invention is attached to the casing of a water faucet for cleaning operation.

Referring to FIG. 4, mounting the recessed hole 29 on the casing of a water faucet or mounting the recessed hole 29 on the L-shaped block 201 which is attached to the surface of a wall close to a water supply terminal and then screw tight the screw 31 to firmly press the plate spring 30 against the casting of the water faucet or the L-shaped block 201, the cup washing machine is secured to the casing of the water faucet or the L-shaped block 201 with the tube brushes 24 which are respectively secured to the output shafts 27 of the gear power transmission mechanism 23 disposed below the outlet hole of the water faucet or the water supply terminal. Then, open the water faucet or the outlet hole of the water supply terminal and turn on the fan motor 22 as soon as the cups to be cleaned are respectively mounted on the tube brushes 24. Therefore, the cups are washed. After washing, the tube brushes 24 are respectively detached from the output shafts 27 of the gear power transmission mechanism 23 and mounted on the ring-shaped recessed holes 33 for air drying.

While the present invention has been described in conjunction with the preferred embodiment thereof, it is to be understood that various modifications and alternations could be made thereunto without departing from the basic teaching and the scope of the present invention. For example, the size of the tube brushes 24 may be variously made without changing the size of the shaft thereof, so that they can be alternatively used for cleaning cups of different diameter.

I claim:

1. A horizontal cup washing machine comprising:

a base integrally made through the process of molding, said base comprising an elongated recess on the bottom edge thereof at one side, a plate spring vertically disposed inside said elongated recess, a lock screw inserted therethrough at an opposite side to press against said plate spring, and a ventilation port at one end;

a cover integrally made through the process of molding, said cover comprising a plurality of ring-shaped recessed holes on the top edge thereof each of which having an elongated groove obliquely extending to the bottom edge of said cover and a stub rod upstanding therefrom at the center;

a fan motor fastened in said said base adjacent to said ventilation port;

a gear transmission mechanism driven by said fan motor to carry a plurality of output shafts to rotate;

a plurality of tube brushes releasably coupled to said output shafts for cleaning cups mounted thereon; and wherein said screw is screwed inwards to tightly squeeze said plate spring against the casing of a water faucet onto which said elongated recess of said base is mounted, permitting the horizontal cup washing machine to be secured to the casing of said water faucet with said tube brushes disposed below the outlet of said water faucet for performing cup cleaning operation.

2. The horizontal cup washing machine of claim 1, which further comprises a L-shaped block fastened in a wall surface adjacent to a water supply outlet onto which said elongated recess can be mounted and the horizontal cup washing machine can be secured by said screw.

3. The horizontal cup washing machine of claim 1, wherein said tube brushes each comprises a shaft for coupling to either of said output shafts of said gear power transmission mechanism or mounted on the stub rod on either of said ring-shaped recessed holes, the shaft of each tube brush having a groove on the outer wall surface thereof and a tapered hole at one end extending in a longitudinal direction, said tapered hole having a raised portion on the inner wall surface thereof, said output shafts each having a groove on the outer wall surface thereof for engaging the raised portion on the shaft of each tube brush, said ring-shaped recessed holes each having a raised portion for engaging into the groove on the tapered hole of the shaft of each tube brush, said stub rod having a groove on the peripheral surface thereof for engaging the raised portion on the shaft of each tube brush.

* * * * *